United States Patent [19]

Ohtani

[11] 4,312,586

[45] Jan. 26, 1982

[54] METHOD AND APPARATUS FOR THE DEVELOPMENT OF FILMS IN A PHOTOGRAPHIC FILM PROCESSOR

[75] Inventor: Masami Ohtani, Kyoto, Japan

[73] Assignee: Dainippon Screen Manufacturing Co., Ltd., Kyoto, Japan

[21] Appl. No.: 155,089

[22] Filed: Jun. 2, 1980

[51] Int. Cl.[3] ..... G03D 3/06

[52] U.S. Cl. ..... 354/321; 354/324; 137/563; 137/572

[58] Field of Search ..... 354/319, 320, 321, 322, 354/324; 137/563, 572; 134/64 P, 122 P, 57 R

[56] References Cited

U.S. PATENT DOCUMENTS

| | | | |
|---|---|---|---|
| 3,626,832 | 12/1971 | Kappeler et al. | 134/122 P |
| 3,841,351 | 10/1974 | Shida | 354/324 |
| 3,983,934 | 10/1976 | Lee | 354/324 |
| 4,215,719 | 8/1980 | Laar et al. | 137/563 |

*Primary Examiner*—Lawrence R. Franklin

*Assistant Examiner*—Alan Mathews

*Attorney, Agent, or Firm*—Wenderoth, Lind & Ponack

[57] ABSTRACT

This invention is concerned with a method and apparatus for the development of photographic films in a photographic film processor in which the films are developed when the exposed films pass through a developing tank containing developer. The object of said invention is to attain uniform development with a simple method, that is, to make the change of the activity of the developer during the development of the films to be treated very small from the leading end to the trailing end of the film. The said invention makes the influence of the momentarily changing activity of the developer in contact with the films as small as possible by compensating for the decrease of the activity due to the exhaustion of the developer by gradually increasing the immersion time of the films in the developer from the leading end toward the trailing end of the photographic films by gradually changing the relative level of the liquid surface when the films are fed into the developer.

5 Claims, 2 Drawing Figures

METHOD AND APPARATUS FOR THE DEVELOPMENT OF FILMS IN A PHOTOGRAPHIC FILM PROCESSOR

BACKGROUND OF THE INVENTION AND PRIOR ART

This invention relates to a method and apparatus to attain uniform development of a film with little difference of the activity of the developer from the leading end to the trailing end of the photographic film when the film is developed by a film processor. By the method and apparatus of the invention, uniform development is achieved by compensating for the decrease of the activity due to the exhaustion of the developer by increasing the length of time the film is immersed in the developer by gradually increasing the surface level of the developer in the developing tank, beginning immediately after the start of the feeding of the film, thus prolonging the time of development.

In development of the photographic films the factors which may affect the density of the developed images on the photographic films are: 1 the activity of the developer, 2 the temperature of the developer, 3 the time of development, 4 the degree of agitation of the developer, etc. In the well-known film processors, such conditions are always maintained constant. However, (a) it is very difficult to keep the activity of the developer constant because the activity changes momentarily with the exhaustion of the developer due to the development of the exposed films. Even if a large amount of the developer is used and the developer is agitated as often as possible to diminish the change of the activity, it is almost impossible to keep the activity of the developer constant, which activity which changes momentarily at every part of the films, e.g. at the leading end or at the trailing end of the films, so as to attain uniform development of photographic films.

In addition, (b) it seems to be advisable to decrease the speed of the films through the developer gradually according to the degree of exhaustion of the developer, but suitable control of the speed of the films is very difficult. Moreover, (c) it is almost impossible to control temperature, that is, to vary the temperature of the liquid in contact with the film appropriately according to the change of the activity of the liquid during the development.

Therefore, it has been the practice to add replenisher in order to maintain the activity of the developer, but so far this has been done for correcting only the average activity of the circulating developer. However, with only such a correction of the activity of the developer it has been impossible to compensate for the difference of the concentration of the developer from the leading end to the trailing end of the film to be treated, as described above. Especially in the development of a film of a large size, the difference of the contrast of the images on the film at the leading part and at the trailing part of the film can not be avoided.

This invention provides a method and an apparatus for the development of the film in a film processor in which the difference of the momentarily changing activity of the developer in contact with the film kept as small as possible, by gradually increasing the length of the film immersed by gradually elevating the surface of the developer from the level of a lower overflow tube according to the difference of the activity occurring during passing of the film to be treated through the developer in the developing tank of the automatic film processor equipped with a supplement tank of the developer and a metering pump, a developing tank to which a higher and a lower overflow tube is attached, and by gradually increasing the time of development from the leading part toward the trailing part of the film. This invention will be described in detail in connection with the drawings in the following.

The said invention makes possible the best compensation by a simple method for the decrease of the concentration of the developer acting on the trailing part of the photographic films due to the exhaustion of the developer, to obtain a uniform development, which is very useful in practice.

DETAILED DESCRIPTION OF THE INVENTION

Figure 1:
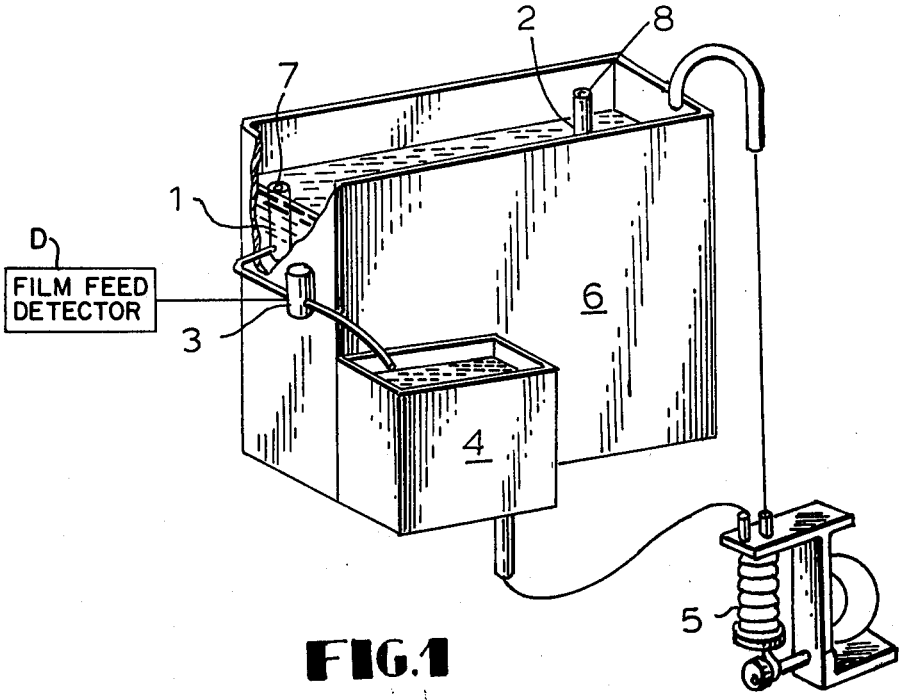
FIG. 1 is a perspective view of a practical embodiment of the developing tank of the film processor according to this invention.

FIG. 1 is a view of a practical embodiment of the film processor of this invention, in which a supplemental tank 4 of developer, and overflow tubes 1 and 2 at a lower overflow lever 7 and a higher overflow level 8, respectively, are provided in the developing tank 6, and a solenoid valve 3 is provided between the lower overflow tube 1 and the supplemental tank 4 and a metering pump 5 is connected between supplemental tank 4 and the developing tank 6. Inside of the developing tank, as shown in FIG. 2, is a film transport device which consists of a combination of rollers 9.

Figure 2:
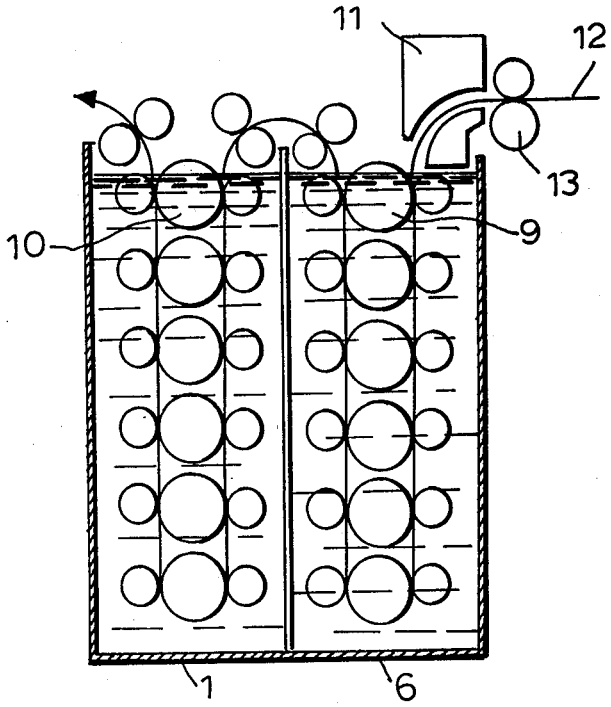
FIG. 2 is a sectional view of the developing tank of FIG. 1 and the fixing tank and showing the film-feeding mechanism of the film processor.

As shown in FIG. 2, an exposed film 12 is carried into the developing tank 6 by a roller 13 along a film guide 11 and is then transported through tank 6 and into the adjacent fixing tank 14 by the rollers 9 after having been passed through the developer. It is then passed through the fixing tank by rollers 10.

In the normal condition, the solenoid valve 3 is open, so that the liquid surface in the developing tank is kept at the level determined by the overflow level 7 of the lower overflow tube 1. When an exposed film to be treated is carried into the developing tank under such condition, the solenoid valve 3 is closed according to a signal, for example, from a film feed detector D, such a a microswitch shown schematically in FIG. 1 arranged in the feeding part, and the overflow of the developer stops because the flow passage from the lower level overflow tube 1 to the supplemental tank 4 is closed while the metering pump 5 continues circulating the developer in the supplemental tank 4 into the developing tank 6, so that the liquid surface in the developing tank 6 increases gradually. Therefore the distance which the film to be treated passes through the developer increases gradually from the leading part toward the trailing part and the time of development increases gradually. Thus the decrease of the activity of the developer during the development of an exposed film is compensated for by increasing the time of development, and thus stable development can be attained by appropriately selecting the speed of the film and the discharge rate of the metering pump, even for treatment of a very long film.

The higher overflow tube 2 is provided to prevent the developer from overflowing over the upper edge of the developing tank 6 when the film to be treated is so long as to require a very long time for feeding. Because the rise of the level of the liquid stops when the liquid surface reaches the level of the higher overflow tube 2 further correction cannot be expected, but if the capacity of the developing tank is such as to attain a sufficient elevation of the liquid surface for the largest film among those to be treated, there will be no trouble during practical use.

As soon as the trailing end of the film has passed the feed detecting microswitch, the signal from the switch stops and the solenoid valve 3 opens, so that the liquid surface is lowered to the upper edge of the lower overflow tube 1 and returns to the normal level. Because during this process it usually takes some time for the trailing end of the film to reach the surface of the developer after passing the microswitch, it is desirable to provide a delay relay or the like to maintain the elevation of the liquid surface.

The return of the liquid surface to the lower level is required to be completed before the leading end of the next film reaches the liquid surface at the feeding side, or after the whole length of the film has completely passed through the liquid and the trailing end of the film has separated from the liquid surface. The reason for this is that the lowering of the level of the liquid surface when only a part of the film has been passed out of the developer causes insufficient development of the part immersed in the liquid, which makes this invention meaningless.

The procedure of this invention is not limited only to the example described above, but, for example, the following procedure may also be employed. That is, the level of the surface of the developer is caused to increase gradually from the upper edge of the lower overflow tube 1 toward the upper edge of the higher overflow tube 2 and the feeding of the film starts earlier than the time when the liquid surface reaches the upper level of the higher overflow tube 2 by an amount of time corresponding to the time required for feeding of the film to be treated determined on the basis of its length. That is, the elevation of the level of the liquid has already begun before the start of feeding of the film and the trailing end of the film is immersed into the developer just when the liquid surface reaches the upper limit; the effect is the same as that in the example described above.

As described above in detail this invention makes possible a reasonable compensation for the decrease of the activity of the developer at the trailing end of the film due to the exhaustion of the developer, by an easy procedure, and this invention is very useful in practice.

What is claimed is:

1. In a method for the development of an exposed photographic film in an automatic film processor by passing the film through a developing tank containing a developer, the improvement comprising gradually varying the liquid level of the developer while feeding the said film into the developer in the developing tank for gradually increasing the time the film is immersed in the developer from the leading end toward the trailing end of the film.

2. The improvement as claimed in claim 1 further comprising returning the level of the surface of the developer to the level prior to the start of the feeding of the film after the feeding of the film into the developer is completed and before the leading end of a next film to be developed reaches the surface of the developer.

3. An automatic film processor comprising a developing tank having means therein for feeding film to be developed through said developing tank while the developing tank holds a developer, a supplemental tank for holding additional developer, an overflow tube in said developing tank having the upper end at a level for maintaining the level of the surface of the developer at a level which is lower than the top of the developing tank, said overflow tube being connected to said supplemental tank, a solenoid valve connected between said overflow tube and said supplemental tank for blocking flow between said overflow tube and said supplemental tank, a pump connected between said supplemental tank and said developing tank for circulating developer from said supplemental tank to said developing tank, and a film feed detector for detecting feeding of film into said developing tank and connected to said solenoid valve for closing said solenoid valve when feeding of film is detected, whereby the level of the developer in said developing tank is gradually increased from the time of start of the feed of film until film is no longer being fed into the developing tank.

4. An automatic film processor as claimed in claim 3 in which said pump is a metering pump.

5. An automatic film processor as claimed in claim 3 in which said film feed detector is a contact switch positioned at the point at which the film is fed into the developing tank.

* * * * *